United States Patent [19]

Harwick et al.

[11] Patent Number: 4,787,628

[45] Date of Patent: Nov. 29, 1988

[54] WEIGHT ADJUSTABLE AUXILIARY BASE UNIT FOR A WEIGHT LIFTING DEVICE

[76] Inventors: Milton C. Harwick; Margaret M. Harwick, both of 3205 S. Third St., Whitehall, Pa. 18052

[21] Appl. No.: 101,807

[22] Filed: Sep. 28, 1987

Related U.S. Application Data

[63] Continuation-in-part of Ser. No. 839,639, Mar. 14, 1986, Pat. No. 4,712,793.

[51] Int. Cl.[4] ..... A63B 21/06

[52] U.S. Cl. ..... 272/118; 272/900; 224/42.42

[58] Field of Search ..... 272/93, 116, 117, 118, 272/119, 123, 143, 900; 206/315.1; 224/42.42, 309, 310, 328

[56] References Cited

U.S. PATENT DOCUMENTS

| | | | |
|---|---|---|---|
| 363,599 | 5/1887 | Coop | 272/118 |
| 3,124,353 | 3/1964 | Sharkey | 272/119 X |
| 3,145,889 | 8/1964 | Altman, Jr. et al. | 224/328 |
| 3,524,643 | 8/1970 | Hazelitt, Sr. | 272/900 X |
| 4,339,061 | 7/1982 | Dunn | 224/42.42 |
| 4,431,185 | 2/1984 | Cisneros | 272/119 X |
| 4,512,503 | 4/1985 | Gioso | 224/42.42 |
| 4,619,386 | 10/1986 | Richardson | 224/42.42 |
| 4,712,793 | 12/1987 | Harwick et al. | 272/118 |

FOREIGN PATENT DOCUMENTS

| | | | |
|---|---|---|---|
| 3528994 | 2/1987 | Fed. Rep. of Germany | 272/117 |

OTHER PUBLICATIONS

Advertisement for the "Pre Pak", In the Journal of Orthopedic and Sports Physical Thearpy, vol. 2, No. 4, Jun. 1981.

*Primary Examiner*—Richard J. Apley
*Assistant Examiner*—Robert D. Bahr
*Attorney, Agent, or Firm*—Steele, Gould & Fried

[57] ABSTRACT

A weight adjustable auxiliary base unit for a weight lifting device is attached to the uppermost weight plate of the weight lifting device. The base unit is generally a compartmentalized box sized to span the width of the weight plates. The box compartments are sized to hold weight bars of identical lengths but of different weights. A self fastening strap is mounted on the box and straps the box to the uppermost of the weight plates.

6 Claims, 1 Drawing Sheet

WEIGHT ADJUSTABLE AUXILIARY BASE UNIT FOR A WEIGHT LIFTING DEVICE

CROSS REFERENCE TO RELATED APPLICATION

This is a continuation-in-part of application Ser. No. 839,639 filed Mar. 14, 1986, now U.S. Pat. No. 4,712,793, entitled WEIGHT MAXIMIZER.

BACKGROUND OF THE INVENTION

1. Field of the Invention

This invention relates to exercising devices and, more particularly, to an auxiliary weight adjustable base unit for a weight lifting device.

2. Description of the Prior Art

There are a variety of weight lifting devices on the market, among which are many that use a cable trained over various pulleys on a frame. One end of the cable has a handgrip and the other cable end is attached to a weight or a base for weights. The lifting device is weight adjustable by stacking weights, generally large and usually ten or eleven pounds each, onto the cable. Even with models which provide the weights in five pound pairs, the weights must be added in the pairs to keep the device balanced and the increment is then ten pounds. There is, therefore, a need for fine weight adjustment in increments of less than ten pounds.

In my prior application, Ser. No. 839,639 fine weight adjustment was achieved by supplying a base plate and a plurality of cylindrical weights, each weighing one-half pound. The plate was attached to the uppermost of the weight lifting device's weights by means of two sided adhesive tape. This device, while satisfactory, has not totally solved the problem. It has been found that the cylindrical weights are difficult to handle, require a storage case, and sometimes roll away when not in use, thus creating a hazard.

There is, therefore, a need for an improved easily attached auxiliary base unit to contain auxiliary weights for fine weight adjustment of a weight lifting device.

SUMMARY OF THE DISCLOSURE

The aforementioned prior art problems are obviated by the weight adjustable auxiliary base unit for a weight lifting device of this invention. The auxiliary base unit is preferably used as one of a pair on a conventional weight lifting device of the kind which has a plurality of weight plates connected to one end of a cable, the cable trained over a plurality of pulleys on a frame and including a handgrip connected to the cable's other end. The auxiliary base unit is a compartmentalized box having four sides, an open top and, preferably, two stacked, spaced apart identically sized bottom plates forming a channel therebetween. The bottom plates are sized to generally span the width of the single weight plates commonly supplied with the weight lifting device. Opposing sides of the box include, preferably, slots which provide access to the channel. A self-fastening, flexible strap is threaded through the slots into the channel to span the box bottom plate and circumscribe at least one of the weight plates. There are preferably four longitudinal compartments in each box, two sized to each receive a rectangular two-pound weight, one sized to receive a one-pound weight, and one sized to receive a half-pound weight. Using two auxiliary base units, one unit placed on each side of the cable on top of the stacked weights, the user is able to finely adjust the amount of weight lifted, by adding from one-half to eleven pounds in auxiliary weight bars.

It is, therefore, an object of this invention to provide an auxiliary base unit for a weight lifting device which preferably adds from one-half to eleven pounds of weight to the device.

It is another object of this invention to provide an auxiliary base unit for a weight lifting device which is easily attached and removed from the weight plate of a weight lifting device.

It is still another object of this invention to provide an auxiliary base unit for a weight lifting device to accommodate auxiliary weights which are flat bars.

It is yet another object of this invention to provide an auxiliary base unit for a weight lifting device which provides auxiliary weights.

These and other objects will be more readily ascertainable to one skilled in the art from a consideration of the following Figures, description and exemplary embodiments.

BRIEF DESCRIPTION OF THE DRAWING(S)

DETAILED DESCRIPTION OF THE PREFERRED EMBODIMENT(S)

Figure 1:
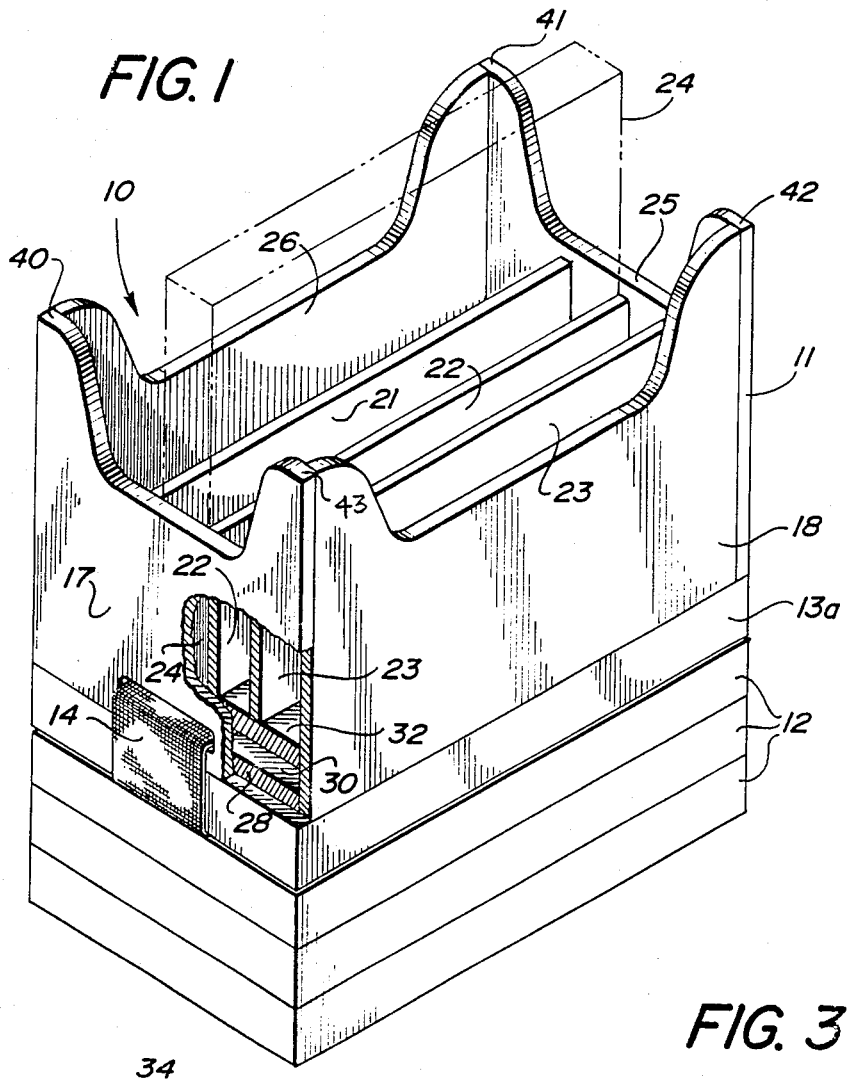
FIG. 1 is a perspective view of the auxiliary base unit in place on a stack of weight plates, the base unit shown in partial cut-away and one auxiliary weight bar shown partially in phantom.

Referring now to the drawings, and more particularly to FIG. 1, auxiliary base unit 10 is shown. Unit 10 is intended for use with a weight lifting device which has a plurality of weight plates (such as plates 12 and 13) connected to one end of a cable. Usually, each weight plate is attached to the cable through its center and the stacked plates are held to the cable with a pin. Weight plates may be single, spanning both sides of the cable, or they may be provided in pairs, one on each side of the cable. The cable is trained over a plurality of pulleys on a frame and has a handgrip at its other end.

Most conventional weight lifting devices of this type use rectangularly shaped weight plates, each weighing either ten or eleven pounds. As the user increases his capabilities, he can increase the weight he is lifting only in increments of ten or eleven pounds, by adding a plate to the stack. Some models use paired five pound weights (one on each cable side)., but the increment is still ten pounds because the weights must be added in pairs to maintain the balance of the device. Auxiliary base unit 10 provides for adding weights in increments of as little as one-half pound up to eleven pounds.

Auxiliary base unit 10 is seen with compartmentalized box 11 held to plate 13*a* by strap 14. Box 11 has sides 17, 18, 25 and 26 and raised corners 40, 41, 42, 43. Bottom plate 28 has a length (from side 17 to side 25) to generally span the width of weight plates 12 and 13*a*, and a width (from side 18 to side 26) to generally span the length of a paired weight plate or generally half the width of a single plate, from one edge of the single plate to the cable.

In FIG. 1, one auxiliary weight bar 24 is seen in phantom. It should be noticed that weight bar 24 occupies the full height of box 11, extending above sides 17, 18, 25, and 26 and beyond corners 40, 41, 42, and 43. By having extending corners, the weights may extend above the sides, but they will be safely retained by the raised corners, without the added weight that full height sides would produce.

Also seen in FIG. 1 is the different widths of the compartments of box 11. The two compartments formed by dividers 21 and wall 26, and by divider 23 and wall 18, are larger than the other compartments. It is preferred that there be two larger compartments sized to accept a two-pound weight bar. It is also preferred that there be one compartment to accept a one-pound weight bar (seen here as formed by dividers 21 and 22) and one compartment to receive a half-pound weight bar (as formed by dividers 22 and 23). By choosing a variety of weights, the user can add from one-half to five and one-half pounds to each auxiliary base unit 10, thus being able to more finely adjust the weights he lifts.

Also seen in FIG. 1 are bottom plate 28 and second bottom plate 32 with channel 30 formed between them. To attach box 11 to weight plate 13*a*, strap 14 is inserted through channel 30 to extend out sides 17 and 25 and circumscribe plate 13*a*. It is preferred that auxiliary base unit 10 be attached to the uppermost of the weight plates, plate 13*a*. When strap 14 is placed around only the uppermost weight plate, the weight of auxiliary base unit 10 and its weight bars keeps strap 14 from sliping out and aids in holding base unit 10 onto plate 13*a*. But it is also possible to supply a longer strap 14 which will circumscribe a number of weight plates. In both cases, strap ends 38 and 39 (seen in FIG. 3) are self-fastening.

Figure 2:
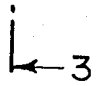
FIG. 2 is a front view of two auxiliary base units in position on the weight plates of a weight lifting device, one unit on each side of the cable of the weight lifting device.

Now referring to FIG. 2, stacked weights 12 and 13*a* and 13*b* are seen with unit 10 strapped to the uppermost weight plate. Two boxes 11 are seen attached, one each, to the tops of weight plate 13*a* and 13*b*. A weight plate may be a single plate with a central aperture therein to permit the weight to be mounted with the cable passing through the aperture and forming two sections (13*a* and 13*b*, as illustrated). Or a weight plate may be two separate weight plates, 13*a* and 13*b*. In either case, a single auxiliary base unit 10 is fastened to each side of cable 34 and housing 36, strapped to plate the uppermost weight plate by strap 14.

Figure 3:
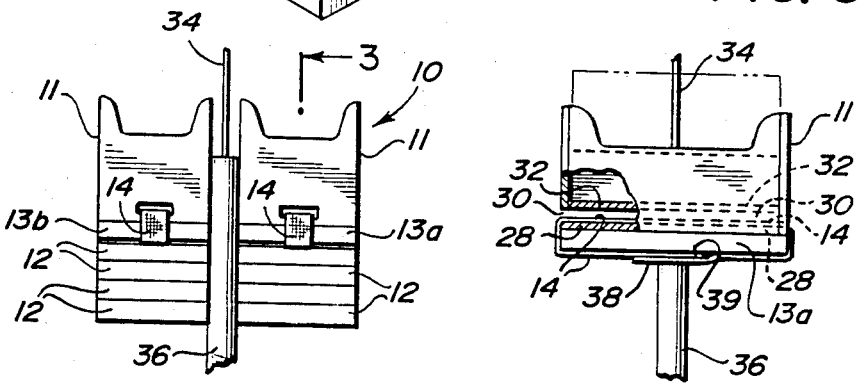
FIG. 3 is a cross section taken on lines 3—3 of FIG. 2, including a partial cutaway and illustrating the self-fastening ends of the strap.

Now referring to FIG. 3, a cross section taken on lines 3—3 of FIG. 2 shows the attachment of box 11 to plate 13*a* on one side of cable 34 and cable housing 36. Box 11 includes bottom plate 28 and second bottom plate 32 which have channel 30 between them for insertion of strap 14. Strap 14 runs through channel 30 and extends outward to be fastened, end 38 to end 39, preferably by interlocking fabric fasteners of the VELCRO brand type.

There are several variations which can be practiced in the scope of this invention. First, although strap 14 is shown running through channel 30 and being self-fastening, other strap fastening means may be substituted, with or without a channel, and be within the scope of this invention.

Second, although four differently sized compartments are shown for a fine weight adjustment, other arrangements, such as identically sized compartments, or no compartments, are within the scope of this invention.

Also, base unit 10 may eliminate the raised corner, utilizing straight full sides, or have other top edge configurations. The sides shown solid could also be provided as a lattice, or have other cut-out configurations.

The base unit is preferably sized to match the length and width of the weights on which it rests, but lesser or greater dimensions would be adequate.

There are many advantages to the present weight adjustable auxiliary base unit for a weight lifting device. Chiefly, it provides for fine weight ajustment and is suitable for use on different models of weight lifting devices.

Also, it provides an additional safety factor over my previously described device because it uses rectangularly shaped weights which do not roll and are easily stored by stacking.

Having now illustrated and described my invention, it is not intended that such description limit this invention, but rather that this invention be limited only by reasonable interpretation of the appended claims.

What is claimed is:

1. A weight adjustable base unit for a weight lifting device of the type having adjustable weight plates connected to one end of a cable, the cable trained over various pulleys on a frame and a handgrip connected to the other end of the cable, said auxiliary base unit comprising:

(a) a compartmentalized box having four sides, an open top and a bottom plate, said bottom plate being sized to generally span the width of said weight plates of said weight lifting device;

(b) means for securing said box to the uppermost of said weight plates; and (c) a plurality of auxiliary weight bars sized to fit one each in one of said box compartments, said bars being generally rectangular and including at least one weighing one-half pound, at least one weighing one pound and at least one weighing two pounds.

2. The weight adjustable auxiliary base unit according to claim 1 wherein said means for securing said box to said weight plates includes a self fastening strap mounted on said box, said strap being of a length to strap said box to at least one of said weights.

3. The weight adjustable auxiliary base unit according to claim 2 wherein said box includes a second bottom plate identically sized to said first bottom plate and wherein said second bottom plate is parallel to but spaced apart from said first bottom plate to create a channel therebetween.

4. The weight adjustable auxiliary base unit according to claim 3 wherein said box includes, additionally, horizontal opposing slots opening into said channel, one slot each located in opposing sides and wherein said strap is of a length to span through said slots to circumscribe said bottom plate and said weight plate simultaneously.

5. The weight adjustable auxiliary base unit according to claim 1 wherein said box is divided into four generally longitudinal compartments, two compartments of equal size, a compartment half the size of said first compartments, and a compartment one-quarter the size of said first compartments.

6. The weight adjustable auxiliary base unit according to claim 1 wherein said auxiliary base unit is supplied as one of a pair, each unit being mounted side by side on opposing cable sides.

* * * * *